US010410776B2

(12) United States Patent
Mino

(10) Patent No.: US 10,410,776 B2
(45) **Date of Patent: *Sep. 10, 2019**

(54) PRODUCTION METHOD FOR R-T-B-BASED SINTERED MAGNET

(71) Applicant: HITACHI METALS, LTD., Minato-ku, Tokyo (JP)

(72) Inventor: Shuji Mino, Mishima-gun (JP)

(73) Assignee: HITACHI METALS, LTD., Tokyo (JP)

( * ) Notice: Subject to any disclaimer, the term of this patent is extended or adjusted under 35 U.S.C. 154(b) by 183 days.

This patent is subject to a terminal disclaimer.

(21) Appl. No.: 15/533,673

(22) PCT Filed: Dec. 4, 2015

(86) PCT No.: PCT/JP2015/084176

§ 371 (c)(1),
(2) Date: Jun. 7, 2017

(87) PCT Pub. No.: WO2016/093174

PCT Pub. Date: Jun. 16, 2016

(65) Prior Publication Data

US 2017/0330659 A1 Nov. 16, 2017

(30) Foreign Application Priority Data

Dec. 12, 2014 (JP) ..... 2014-251406

(51) Int. Cl.
*H01F 41/02* (2006.01)
*H01F 1/057* (2006.01)
(Continued)

(52) U.S. Cl.
CPC ..... *H01F 1/0577* (2013.01); *B22F 3/24* (2013.01); *B22F 7/06* (2013.01); *B22F 7/062* (2013.01);
(Continued)

(58) Field of Classification Search
None
See application file for complete search history.

(56) References Cited

U.S. PATENT DOCUMENTS

2007/0240789 A1* 10/2007 Nakamura ..... H01F 41/0293 148/101
2009/0226339 A1 9/2009 Nakamura et al.
(Continued)

FOREIGN PATENT DOCUMENTS

JP 2007-287874 A 11/2007
JP 2007-287875 A 11/2007
(Continued)

*Primary Examiner* — Xiaowei Su
(74) *Attorney, Agent, or Firm* — Keating & Bennett, LLP

(57) ABSTRACT

A step of, while an RLM alloy powder (where RL is Nd and/or Pr; M is one or more elements selected from among Cu, Fe, Ga, Co, Ni and Al) and an RH oxide powder (where RH is Dy and/or Tb) are present on the surface of a sintered R-T-B based magnet, performing a heat treatment at a sintering temperature of the sintered R-T-B based magnet or lower is included. The RLM alloy contains RL in an amount of 50 at % or more, and the melting point of the RLM alloy is equal to or less than the temperature of the heat treatment. The heat treatment is performed while the RLM alloy powder and the RH oxide powder are present on the surface of the sintered R-T-B based magnet at a mass ratio of RLM alloy:RH oxide=9.6:0.4 to 5:5.

4 Claims, 2 Drawing Sheets

(51) Int. Cl.

| | |
|---|---|
| ***B22F 3/10*** | (2006.01) |
| ***B22F 3/24*** | (2006.01) |
| ***B22F 7/02*** | (2006.01) |
| ***C22C 33/02*** | (2006.01) |
| ***H01F 1/053*** | (2006.01) |
| ***B22F 7/06*** | (2006.01) |
| *C22C 38/00* | (2006.01) |
| *C22C 28/00* | (2006.01) |

(52) U.S. Cl.

CPC ..... *B22F 7/064* (2013.01); *C22C 33/02* (2013.01); *H01F 1/0536* (2013.01); *H01F 41/02* (2013.01); *H01F 41/0293* (2013.01); *C22C 28/00* (2013.01); *C22C 38/00* (2013.01); *C22C 2202/02* (2013.01)

(56) References Cited

U.S. PATENT DOCUMENTS

| | | | | |
|---|---|---|---|---|
| 2012/0139388 | A1* | 6/2012 | Iwasaki | B22F 3/24<br>310/254.1 |
| 2015/0211138 | A1* | 7/2015 | Nagasaki | C22C 38/002<br>148/102 |
| 2017/0263379 | A1* | 9/2017 | Mino | C22F 1/16 |
| 2017/0263380 | A1* | 9/2017 | Mino | B22F 3/24 |

FOREIGN PATENT DOCUMENTS

| | | | |
|---|---|---|---|
| JP | 2012-248827 | A | 12/2012 |
| JP | 2012-248828 | A | 12/2012 |

* cited by examiner

PRODUCTION METHOD FOR R-T-B-BASED SINTERED MAGNET

TECHNICAL FIELD

The present invention relates to a method for producing a sintered R-T-B based magnet containing an $R_2T_{14}B$-type compound as a main phase (where R is a rare-earth element; T is Fe or Fe and Co).

BACKGROUND ART

Sintered R-T-B based magnets whose main phase is an $R_2T_{14}B$-type compound are known as permanent magnets with the highest performance, and are used in voice coil motors (VCMs) of hard disk drives, various types of motors such as motors to be mounted in hybrid vehicles, home appliance products, and the like.

Intrinsic coercivity $H_{cJ}$ (hereinafter simply referred to as "$H_{cJ}$") of sintered R-T-B based magnets decreases at high temperatures, thus causing an irreversible flux loss. In order to avoid irreversible flux losses, when used in a motor or the like, they are required to maintain high $H_{cJ}$ even at high temperatures.

It is known that if R in the $R_2T_{14}B$-type compound phase is partially replaced with a heavy rare-earth element RH (Dy, Tb), $H_{cJ}$ of a sintered R-T-B based magnet will increase. In order to achieve high $H_{cJ}$ at high temperature, it is effective to profusely add a heavy rare-earth element RH in the sintered R-T-B based magnet. However, if a light rare-earth element RL (Nd, Pr) that is an R in a sintered R-T-B based magnet is replaced with a heavy rare-earth element RH, $H_{cJ}$ will increase but there is a problem of decreasing remanence $B_r$ (hereinafter simply referred to as "$B_r$"). Furthermore, since heavy rare-earth elements RH are rare natural resources, their use should be cut down.

Accordingly, in recent years, it has been attempted to improve $H_{cJ}$ of a sintered R-T-B based magnet with less of a heavy rare-earth element RH, this being in order not to lower $B_r$. For example, as a method of effectively supplying a heavy rare-earth element RH to a sintered R-T-B based magnet and diffusing it, Patent Documents 1 to 4 disclose methods which perform a heat treatment while a powder mixture of an RH oxide or RH fluoride and any of various metals M, or an alloy containing M, is allowed to exist on the surface of a sintered R-T-B based magnet, thus allowing the RH and M to be efficiently absorbed to the sintered R-T-B based magnet, thereby enhancing $H_{cJ}$ of the sintered R-T-B based magnet.

Patent Document 1 discloses use of a powder mixture of a powder containing M (where M is one, or two or more, selected from among Al, Cu and Zn) and an RH fluoride powder. Patent Document 2 discloses use of a powder of an alloy RTMAH (where M is one, or two or more, selected from among Al, Cu, Zn, In, Si, P, and the like; A is boron or carbon; H is hydrogen), which takes a liquid phase at the heat treatment temperature, and also that a powder mixture of a powder of this alloy and a powder such as RH fluoride may also be used.

Patent Document 3 and Patent Document 4 disclose that, by using a powder mixture including a powder of an RM alloy (where M is one, or two or more, selected from among Al, Si, C, P, Ti, and the like) and a powder of an M1M2 alloy (M1 and M2 are one, or two or more, selected from among Al, Si, C, P, Ti, and the like), and an RH oxide, it is possible to partially reduce the RH oxide with the RM alloy or the M1M2 alloy during the heat treatment, thus allowing more R to be introduced into the magnet.

CITATION LIST

Patent Literature

[Patent Document 1] Japanese Laid-Open Patent Publication No. 2007-287874

[Patent Document 2] Japanese Laid-Open Patent Publication No. 2007-287875

[Patent Document 3] Japanese Laid-Open Patent Publication No. 2012-248827

[Patent Document 4] Japanese Laid-Open Patent Publication No. 2012-248828

SUMMARY OF INVENTION

Technical Problem

The methods described in Patent Documents 1 to 4 deserve attention in that they allow more RH to be diffused into a magnet. However, these methods cannot effectively exploit the RH which is present on the magnet surface in improving $H_{cJ}$, and thus need to be bettered. Especially in Patent Document 3, which utilizes a powder mixture of an RM alloy and an RH oxide, Examples thereof indicate that what is predominant is actually the $H_{cJ}$ improvements that are due to diffusion of the RM alloy, while there is little effect of using an RH oxide, such that the RM alloy presumably does not exhibit much effect of reducing the RH oxide.

Furthermore, the methods described in Patent Documents 1 to 4 have the following problems associated with the presence of a powder mixture containing an RH oxide powder on the magnet surface. That is, in their specific disclosure, these methods immerse a magnet into a slurry which is obtained by dispersing the aforementioned powder mixture in water or an organic solvent, and then retrieve it (dip coating technique). In this context, hot air drying or natural drying is performed for the magnet that has been lifted out of the slurry. Instead of thus immersing the magnet into a slurry, spraying a slurry onto a magnet is also disclosed (spray coating technique). However, in a dip coating technique, the slurry will inevitably abound below the magnet, owing to gravity. On the other hand, the spray coating technique will result in a large coating thickness at the magnet end, owing to surface tension. Both methods have difficulty in allowing the RH oxide to be uniformly present on the magnet surface. This leads to a problem in that the $H_{cJ}$ after heat treatment will considerably fluctuate.

The present invention has been made in view of the above circumstances, and provides a method for producing a sintered R-T-B based magnet with high $H_{cJ}$, by reducing the amount of RH to be present on the magnet surface and yet effectively diffusing it inside the magnet. Moreover, by allowing RH to be uniformly present on the magnet surface and applying a heat treatment thereto, a method is provided for producing a sintered R-T-B based magnet with high $H_{cJ}$, without fluctuations in the $H_{cJ}$ improvement.

Solution to Problem

In one illustrative implementation, a method for producing a sintered R-T-B based magnet according to the present invention is a method including: a step of performing a heat treatment at a sintering temperature of the sintered R-T-B based magnet or lower, while an RLM alloy powder (where RL is Nd and/or Pr; M is one or more elements selected from among Cu, Fe, Ga, Co, Ni and Al) and an RH oxide powder (where RH is Dy and/or Tb) are present on a surface of a sintered R-T-B based magnet that is provided, wherein at least the RH oxide is allowed to be present in the form of a sheet compact containing an RH oxide powder and a resin component. The RLM alloy contains RL in an amount of 50 at % or more, and a melting point thereof is equal to or less than a temperature of the heat treatment. The heat treatment is performed while RLM alloy powder and the RH oxide powder are present on the surface of the sintered R-T-B based magnet at a mass ratio of RLM alloy:RH oxide=9.6:0.4 to 5:5.

In a preferred embodiment, in the sheet compact containing the RH oxide powder and the resin component to be present on the surface of the sintered R-T-B based magnet, the amount of the RH element is 0.03 to 0.35 mg per 1 $mm^2$ of the surface.

One embodiment includes a step of coating the surface of the sintered R-T-B based magnet with a layer of RLM alloy powder particles, and placing thereon the sheet compact containing the RH oxide.

One embodiment includes a step of placing a sheet compact containing an RLM alloy powder and a resin component on the surface of the sintered R-T-B based magnet, and placing thereon a sheet compact containing an RH oxide powder and a resin component.

One embodiment includes a step of placing, on the surface of the sintered R-T-B based magnet, a sheet compact containing a powder mixture of an RLM alloy powder and an RH oxide powder and a resin component.

Advantageous Effects of Invention

According to an embodiment of the present invention, an RLM alloy is able to reduce an RH oxide with a higher efficiency than conventional, thus allowing RH to be diffused inside a sintered R-T-B based magnet. As a result, with a smaller RH amount than in the conventional techniques, $H_{cJ}$ can be improved to a similar level to or higher than by the conventional techniques, without fluctuations.

DESCRIPTION OF EMBODIMENTS

Figure 1:
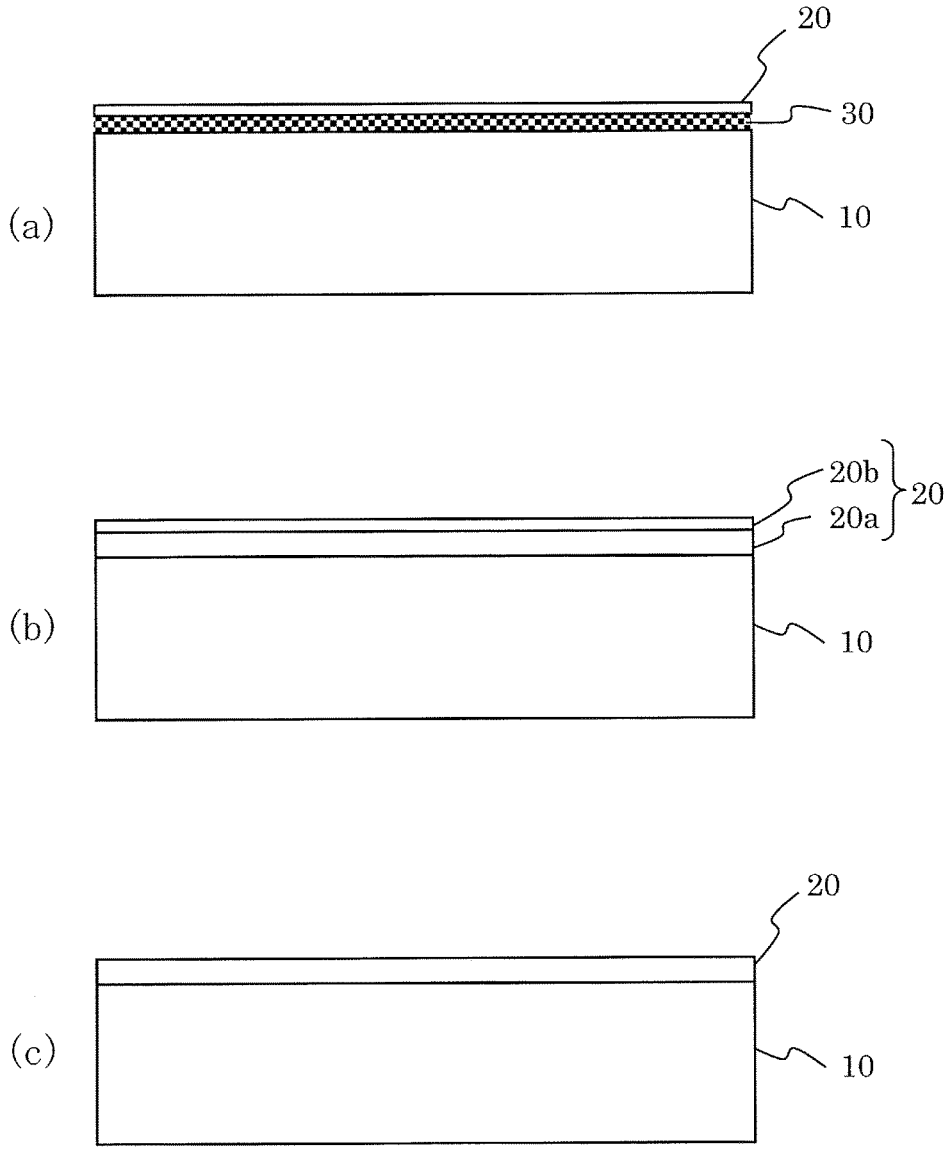
FIG. 1 Each of (a) to (c) is a cross-sectional view showing an example relative positioning between a sintered magnet and a sheet compact(s).

In one illustrative implementation, a method for producing a sintered R-T-B based magnet according to the present invention includes: a step of performing a heat treatment at a sintering temperature of the sintered R-T-B based magnet or lower, while an RLM alloy powder (where RL is Nd and/or Pr; M is one or more elements selected from among Cu, Fe, Ga, Co, Ni and Al) and an RH oxide powder (where RH is Dy and/or Tb) are present on a surface of a sintered R-T-B based magnet that is provided. In this method, at least the RH oxide is allowed to be present in the form of a sheet compact containing an RH oxide powder and a resin component. The RLM alloy contains RL in an amount of 50 at % or more, and a melting point thereof is equal to or less than a temperature of the heat treatment. In an embodiment of the present invention, a heat treatment is performed while a powder of the RLM alloy and a powder of the RH oxide are present on the surface of the sintered R-T-B based magnet at a mass ratio of RLM alloy:RH oxide=9.6:0.4 to 5:5.

As a method of improving $H_{cJ}$ by making effective use of smaller amounts of RH, the inventor has thought as effective a method which performs a heat treatment while an RH oxide is present, on the surface of a sintered R-T-B based magnet, together with a diffusion auxiliary agent that reduces the RH oxide during the heat treatment. Through a study by the inventor, it has been found that an alloy (RLM alloy) which combines a specific RL and M, the RLM alloy containing RL in an amount of 50 at % or more and having a melting point which is equal to or less than the heat treatment temperature, provides an excellent ability to reduce the RH oxide that is present on the magnet surface. It has been further found that, when at least the RH oxide is allowed to be present in the form of a sheet compact containing an RH oxide powder and a resin component, the RH oxide can be uniformly present on the magnet surface without being affected by gravity or surface tension, thus consequently eliminating fluctuations in the $H_{cJ}$ improvement. It has also been found that the RH oxide can be uniformly present even if the magnet surface is a curved surface, and that performing the process while the lower face of the magnet is also enwrapped with a sheet compact will allow for a process that is based on a very simple method, without the cumbersomeness of two-times application, etc.

In the present specification, any substance containing an RH is referred to as a "diffusion agent", whereas any substance that reduces the RH in a diffusion agent so as to render it ready to diffuse is referred to as a "diffusion auxiliary agent".

Hereinafter, preferable embodiments of the present invention will be described in detail.

[Sintered R-T-B Based Magnet Matrix]

First, a sintered R-T-B based magnet matrix, in which to diffuse a heavy rare-earth element RH, is provided in the present invention. In the present specification, for ease of understanding, a sintered R-T-B based magnet in which to diffuse a heavy rare-earth element RH may be strictly differentiated as a sintered R-T-B based magnet matrix; it is to be understood that the term "sintered R-T-B based magnet" is inclusive of any such "sintered R-T-B based magnet matrix". Those which are known can be used as this sintered R-T-B based magnet matrix, having the following composition, for example.

rare-earth element R: 12 to 17 at %

B ((boron), part of which may be replaced with C (carbon)): 5 to 8 at % additive element(s) M' (at least one selected from the group consisting of Al, Ti, V, Cr, Mn, Ni, Cu, Zn, Ga, Zr, Nb, Mo, Ag, In, Sn, Hf, Ta, W, Pb and Bi): 0 to 2 at %

T (transition metal element, which is mainly Fe and may include Co) and inevitable impurities: balance Herein, the rare-earth element R consists essentially of a light rare-earth element RL (Nd and/or Pr), but may contain a heavy rare-earth element RH. In the case where a heavy rare-earth element is to be contained, preferably at least one of Dy and Tb is contained.

A sintered R-T-B based magnet matrix of the above composition is produced by any arbitrary production method.

[Diffusion Auxiliary Agent]

As the diffusion auxiliary agent, a powder of an RLM alloy is used. Suitable RL's are light rare-earth elements having a high effect of reducing RH oxides; and RL is Nd and/or Pr. M is one or more selected from among Cu, Fe, Ga, Co, Ni and Al. Among others, use of an Nd—Cu alloy or an Nd—Al alloy is preferable because Nd's ability to reduce an RH oxide will be effectively exhibited and a higher effect of $H_{cJ}$ improvement will be obtained. As the RLM alloy, an alloy is used which contains RL in an amount of 50 at % or more, such that the melting point thereof is equal to or less than the heat treatment temperature. The RLM alloy preferably contains RL in an amount of 65 at % or more. Since RL has a high ability to reduce an RH oxide, and its melting point is equal to or less than the heat treatment temperature, an RLM alloy containing RL in an amount of 50 at % or more will melt during the heat treatment to efficiently reduce the RH oxide, and the RH which has been reduced at a higher rate will diffuse into the sintered R-T-B based magnet, such that it can efficiently improve $H_{cJ}$ of the sintered R-T-B based magnet even in a small amount. As the method of allowing an RLM alloy powder to be present on the magnet surface, a slurry which is produced by mixing the RLM alloy powder with a binder and/or a solvent such as pure water or an organic solvent may be applied, or a sheet compact that contains the RLM alloy powder and a resin component, or the RLM alloy powder and an RH oxide powder with a resin component, may be placed on the magnet surface. From the standpoints of attaining uniform application and ease of compacting to form a sheet compact, the particle size of the RLM alloy powder is preferably 500 μm or less. The particle size of the RLM alloy powder is preferably 150 μm or less, and more preferably 100 μm or less. Too small a particle size of the RLM alloy powder is likely to result in oxidation, and from the standpoint of oxidation prevention, the lower limit of the particle size of the RLM alloy powder is about 5 μm. Typical examples of the particle size of the RLM alloy powder are 20 to 100 μm.

[Diffusion Agent]

As the diffusion agent, a powder of an RH oxide (where RH is Dy and/or Tb) is used. The RH oxide powder is equal to or less than the RLM alloy powder by mass ratio; therefore, for uniform application of the RH oxide powder, the particle size of the RH oxide powder is preferably small. According to a study by the inventor, the particle size of the RH oxide powder is preferably 20 μm or less, and more preferably 10 μm or less in terms of the aggregated particle size. Smaller ones are on the order of several μm as primary particles.

[Sheet Compact(s) and Placement Thereof]

Together with the RLM alloy powder, which is a diffusion auxiliary agent, the RH oxide powder, which is a diffusion agent, is placed on the magnet surface in the form of a sheet compact containing the RH oxide powder itself and the resin component. The method of placing a sheet compact containing an RH oxide and a resin component on the magnet surface together with an RLM alloy powder involves coating the magnet surface with a layer of RLM alloy powder particles, and placing thereon a sheet compact that contains the RH oxide. Moreover, this method may involve placing a sheet compact that contains an RLM alloy powder and a resin component on the magnet surface, and placing thereon a sheet compact that contains an RH oxide powder and a resin component. Furthermore, this method may involve placing on the magnet surface a sheet compact that contains a powder mixture of an RLM alloy powder and an RH oxide powder and the resin component as well as a resin component.

FIG. 1(*a*) shows a state where an RLM alloy powder is applied on the upper face of a sintered R-T-B based magnet 10 to form a layer 30 of RLM alloy powder particles, upon which a sheet compact 20 that contains an RH oxide powder and a resin component is placed.

FIG. 1(*b*) shows a state where a sheet compact 20*a* that contains an RLM alloy powder and a resin component is placed on the upper face of a sintered R-T-B based magnet 10, upon which a sheet compact 20*b* that contains an RH oxide powder and a resin component is placed. In other words, the sheet compact 20 in this example has a multilayer structure including the sheet compact 20*a* and the sheet compact 20*b*.

FIG. 1(*c*) shows a state where a sheet compact 20 that contains an RLM alloy powder, an RH oxide powder and a resin component is placed on the upper face of a sintered R-T-B based magnet 10. In the sheet compact 20 of this example, typically, the RLM alloy powder and the RH oxide powder are in a mixed state; however, they do not need to be in a uniformly mixed state. The density of the RLM alloy powder and the density of the RH oxide powder in the sheet compact 20 do not need to be uniform along a perpendicular direction to the magnet surface, but may be distributed.

In the example shown in FIG. 1, the sheet compact 20 is provided on the upper face of the sintered R-T-B based magnet 10; however, this is only an example. One sheet compact 20 may cover the entirety (including the lower face and the side faces) of the sintered R-T-B based magnet 10, or only a portion thereof; alternatively, a plurality of sheet compacts 20 may cover the entirety or only a portion of the sintered magnet 10.

Figure 2:
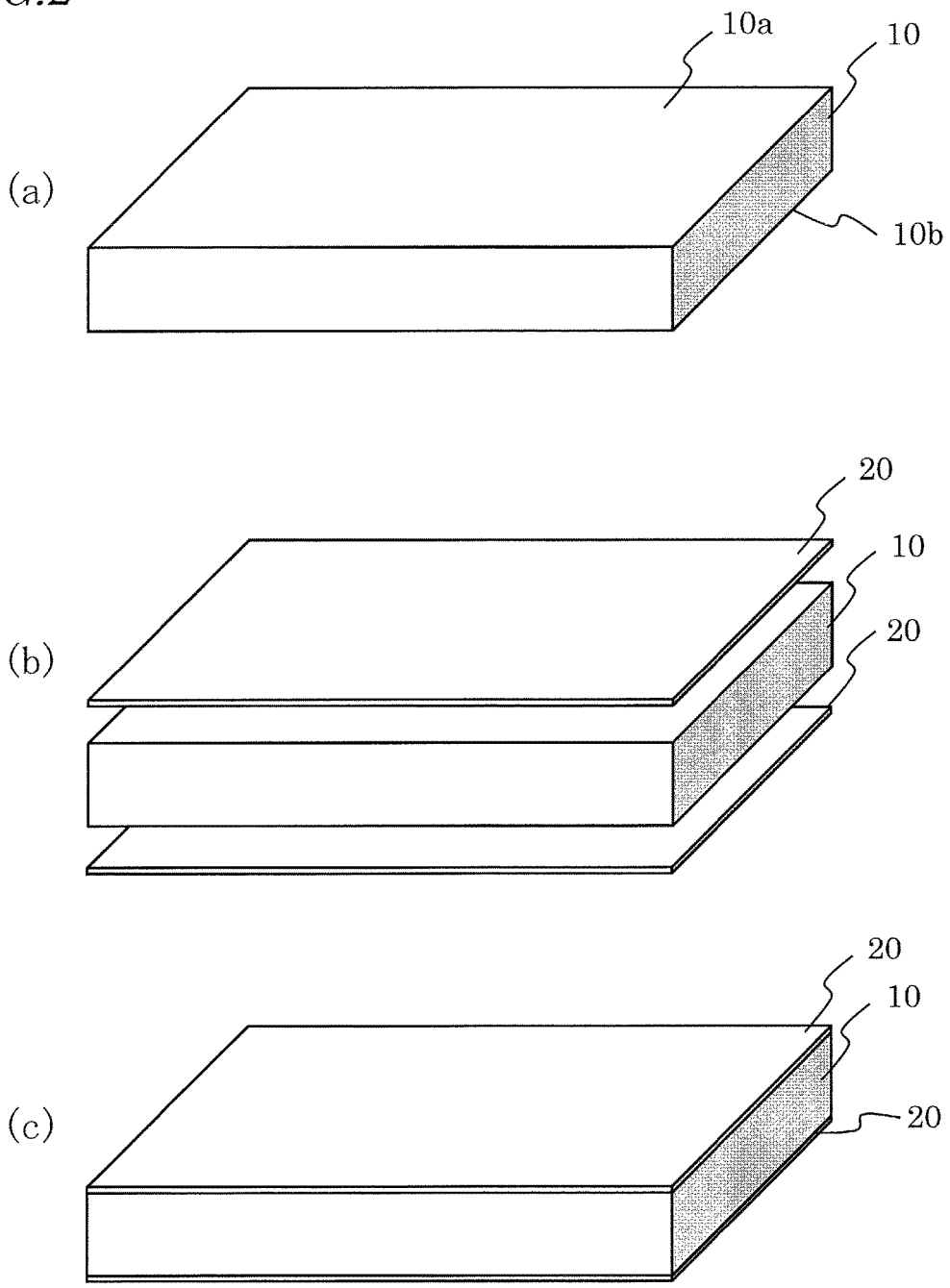
FIG. 2 (*a*) to (*c*) are perspective views showing example steps of providing sheet compacts on a sintered magnet.

Next, as an example, a case will be described where a sintered R-T-B based magnet 10 having an upper face 10*a* and a lower face 10*b* as shown in FIG. 2(*a*) is provided. In the figure, for simplicity, the upper face 10*a* and the lower face 10*b* of the sintered magnet 10 are illustrated as planes; however, at least one of the upper face 10*a* and the lower face 10*b* of the sintered R-T-B based magnet 10 may be a curved surface, or have rises and falls or a stepped portion.

In the example described herein, as shown in FIG. 2(*b*), two sheet compacts 20 are provided for one sintered R-T-B based magnet 10 such that, as shown in FIG. 2(*c*), the two sheet compacts 20 are in contact with the upper face 10*a* and the lower face 10*b* of the sintered R-T-B based magnet 10, respectively. In this state, a diffusion heat treatment to be described later is performed. Note that FIGS. 2(*a*) to (*c*) illustrate only the relative positioning between the two sheet compacts 20. In this case, too, as was shown in FIGS. 1(*a*) to (*c*), an RLM alloy powder may be applied on the upper face of the sintered R-T-B based magnet 10 to form a layer 30 of RLM alloy powder particles, upon which a sheet compact 20 that contains an RH oxide powder and a resin component may be placed. Alternatively, a sheet compact 20*a* that contains an RLM alloy powder and a resin component may be placed on the upper face of the sintered R-T-B based magnet 10, upon which a sheet compact 20*b* that contains an RH oxide powder and a resin component may be placed. Alternatively, a sheet compact 20 that contains an RLM alloy powder, an RH oxide powder and a resin component may be placed on the upper face of the sintered R-T-B based magnet 10.

A sheet compact may be produced in the following manner, for example. That is, an RH oxide powder and/or an RLM alloy powder and a resin component are mixed with a solvent such as water or an organic solvent, and this is applied onto a polyethylene terephthalate (PET) film, a polytetrafluoroethylene (fluoroplastic) film, or the like. Then, after drying is performed to remove the solvent, it is detached from the PET film or fluoroplastic film. Thereafter, the sheet compact may be cut according to the size of the magnet surface.

During the temperature elevating process of a heat treatment to be performed in a state where the sheet compact is in contact with the magnet, the resin component is removed via pyrolysis, evaporation, etc., from the surface of the sintered R-T-B based magnet at a temperature which is equal to or less than the melting point of the diffusion auxiliary agent. Therefore, although there is no particular limitation as to the type of the resin component, binders which are easy to dissolve into a highly volatile solvent, e.g., a polyvinyl acetal resin such as polyvinyl butyral (PVB), are preferable, because of using them will make it easy to obtain a sheet compact. Moreover, plasticizer may be added in order to render the sheet compact flexible.

Also, the thickness of the sheet compact and the ratio between the RH oxide powder and/or RLM alloy powder and the resin component do not directly contribute to $H_{cJ}$ improvement, and are not particularly limited. The amounts of the RH oxide powder and/or the RLM alloy powder are more important than the amount of the resin component. From the standpoints of ease of sheet compacting, ease of placement work, and residual impurities, the thickness of the sheet compact is preferably 10 to 300 μm. For similar reasons, the ratio between the RH oxide powder and/or RLM alloy powder and the resin component is preferably such that the resin component accounts for 30 to 50 vol % based on a total volume defined as 100 vol %.

A sheet compact may be placed on each face of the magnet, or a part or a whole of the magnet may be enwrapped by a sheet compact. A sheet compact having a tacky surface is easy to be placed on the magnet surface, and therefore is preferable. A sheet compact having been placed on the magnet surface may then be straightforwardly subjected to a heat treatment; however, it would also be possible to spray a solvent such as ethanol to partially dissolve the resin component so that it is in close contact with the magnet surface, thus attaining better handling.

In the case of forming a layer of RLM alloy powder particles via coating, a slurry which is produced by uniformly mixing an RLM alloy powder and a binder and/or a solvent may be applied onto the magnet surface and then dried; or, a sintered R-T-B based magnet may be immersed in a solution in which an RLM alloy powder is dispersed in a solvent such as pure water or an organic solvent, and then pulled upward and dried. Since the amount of applied RLM alloy powder does not directly affect the degree of $H_{cJ}$ improvement, it may somewhat fluctuate due to gravity or surface tension. Without particular limitation, any binder and/or solvent may be used that can be removed via pyrolysis or evaporation, etc., from the surface of the sintered R-T-B based magnet at a temperature which is equal to or less than the melting point of the RLM alloy during the temperature elevating process in a subsequent heat treatment.

In the method of the present invention, the RLM alloy melts during the heat treatment because of its melting point being equal to or less than the heat treatment temperature, thus resulting in a state which allows the RH that has been reduced highly efficiently to easily diffuse to the inside of the sintered R-T-B based magnet. Therefore, no particular cleansing treatment, e.g., pickling, needs to be performed for the surface of the sintered R-T-B based magnet prior to introducing the RLM alloy powder and the RH oxide powder onto the surface of the sintered R-T-B based magnet. Of course, this is not to say that such a cleansing treatment should be avoided.

The ratio by which the RLM alloy that is applied to or contained in the sheet compact and the RH oxide that is contained in the sheet compact are present on the surface of the sintered R-T-B based magnet (before the heat treatment) is, by mass ratio, RLM alloy:RH oxide=9.6:0.4 to 5:5. A more preferable ratio by which they are present is RLM alloy:RH oxide=9.5:0.5 to 6:4. Although the present invention does not necessarily exclude presence of any powder (third powder) other than the RLM alloy and RH oxide powders on the surface of the sintered R-T-B based magnet as it becomes applied to or contained in the sheet compact, care must be taken so that any third powder will not hinder the RH in the RH oxide from diffusing to the inside of the sintered R-T-B based magnet. It is desirable that the "RLM alloy and RH compound" powders account for a mass ratio of 70% or more in all powder that is present on the surface of the sintered R-T-B based magnet.

According to the present invention, it is possible to efficiently improve $H_{cJ}$ of the sintered R-T-B based magnet with a small amount of RH. The amount of RH in the sheet compact to be present on the surface of the sintered R-T-B based magnet is preferably 0.03 to 0.35 mg per 1 $mm^2$ of magnet surface, and more preferably 0.05 to 0.25 mg.

[Diffusion Heat Treatment]

While the RLM alloy powder and the RH oxide powder are allowed to be present on the surface of the sintered R-T-B based magnet, a heat treatment is performed. Since the RLM alloy powder will melt after the heat treatment is begun, the RLM alloy does not always need to maintain a "powder" state during the heat treatment. The ambient for the heat treatment is preferably a vacuum, or an inert gas ambient. The heat treatment temperature is a temperature which is equal to or less than the sintering temperature (specifically, e.g. 1000° C. or less) of the sintered R-T-B based magnet, and yet higher than the melting point of the RLM alloy. The heat treatment time is 10 minutes to 72 hours, for example. After the above heat treatment, a further heat treatment for improving the magnetic characteristics may be conducted, as necessary, at 400 to 700° C. for 10 minutes to 72 hours.

EXAMPLES

[Producing a Sintered R-T-B Based Magnet Matrix]

First, by a known method, a sintered R-T-B based magnet with the following mole fractions was produced: Nd=13.4, B=5.8, Al=0.5, Cu=0.1, Co=1.1, balance=Fe (at %). By machining this, a sintered R-T-B based magnet matrix which was 6.9 mm×7.4 mm×7.4 mm was obtained. Magnetic characteristics of the resultant sintered R-T-B based magnet matrix were measured with a B-H tracer, which indicated an $H_{cJ}$ of 1035 kA/m and a $B_r$ of 1.45 T. As will be described later, magnetic characteristics of the sintered R-T-B based magnet having undergone the heat treatment are to be measured only after the surface of the sintered R-T-B based magnet is removed via machining. Accordingly, the sintered R-T-B based magnet matrix also had its surface removed via machining by 0.2 mm each, thus resulting in a 6.5 mm×7.0 mm×7.0 mm size, before the measurement was taken. The amounts of impurities in the sintered R-T-B based magnet matrix was separately measured with a gas analyzer, which showed oxygen to be 760 mass ppm, nitrogen 490 mass ppm, and carbon 905 mass ppm.

In the following, experimentation was conducted with this sintered R-T-B based magnet matrix, except in Experimental Example 5 where sintered R-T-B based magnet matrices of various compositions were used.

[Producing Sheet Compacts Containing an RH Oxide]

Sheet compacts containing an RH oxide were produced as follows. First, 50 g of $Tb_4O_7$ powder with a particle size of 10 μm or less, a solvent mixture of ethanol and butanol, and 1 kg of φ5 mm zirconia balls as a medium were placed in a ball mill, and were subjected to disintegration and mixing for 7 hours, thereby preparing a slurry in which $Tb_4$ $O_7$ accounted for 45 wt %. A resin mixture of PVB and a plasticizer were mixed with the slurry so that the $Tb_4O_7$ powder accounted for 60 vol % and the resin mixture 40 vol %, and after 15 hours of agitation at 50 to 60° C., it was subjected to vacuum defoaming, thereby producing a slurry to be compacted. The resultant slurry to be compacted was thinly spread over a PET film. After drying, the PET film was detached, thereby producing $Tb_4O_7$ sheets with thicknesses of 50 μm (per 1 $mm^2$, Tb amount=0.14 mg and $Tb_4O_7$ amount=0.18 mg), 25 μm (per 1 $mm^2$, Tb amount=0.07 mg and $Tb_4O_7$ amount=0.09 mg), and 15 μm (per 1 $mm^2$, Tb amount=0.04 mg and $Tb_4O_7$ amount=0.05 mg). With the same method, $Dy_2O_3$ sheets with thicknesses of 50 μm (Dy amount=0.14 mg per 1 $mm^2$) and 25 μm (Dy amount=0.07 mg per 1 $mm^2$) were also produced.

Experimental Example 1

A diffusion auxiliary agent having a composition as shown in Table 1 was provided. As the diffusion auxiliary agent, a spherical powder with a particle size of 100 μm or less which had been produced by a centrifugal atomization technique (i.e., from which particles of particle sizes above 100 μm had been removed by sieving) was used. This powder of diffusion auxiliary agent and a 5 mass % aqueous solution of polyvinyl alcohol were mixed so that the diffusion auxiliary agent and the polyvinyl alcohol aqueous solution had a ratio by weight of 2:1, thereby obtaining a slurry.

This slurry was applied onto two 7.4 mm×7.4 mm faces of the sintered R-T-B based magnet matrix, so that the mass ratio between the diffusion auxiliary agent in the slurry and the diffusion agent in the $Tb_4O_7$ sheet or $Dy_2O_3$ sheet would attain values as shown in Table 1. Specifically, the slurry was applied to a 7.4 mm×7.4 mm upper face of the sintered R-T-B based magnet matrix, and dried at 85° C. for 1 hour. Thereafter, the sintered R-T-B based magnet matrix was placed upside down, and the slurry was similarly applied and dried. Note that the melting point of the diffusion auxiliary agent, as will be discussed in this Example, denotes a value as read from a binary phase diagram of the RLM alloy.

Next, after applying the slurry, $Tb_4O_7$ sheets or $Dy_2O_3$ sheets as described in Table 1 and having been cut into 7.4 mm×7.4 mm were placed on the dried magnet surface. After a small amount of ethanol was sprayed from above, they were subjected to hot air drying with a drier, whereby each sheet was placed in close contact with the magnet surface (Samples 1 to 8). As Comparative Examples, Sample 9 in which no RH oxide sheets were placed, Sample 10 in which only 50 μm $Tb_4O_7$ sheets were placed without applying a slurry containing a diffusion auxiliary agent, and Sample 11 in which only $Dy_2O_3$ sheets were placed similarly were also provided.

TABLE 1

| Sample No. | diffusion auxiliary agent composition (at. ratio) | diffusion auxiliary agent melting point (° C.) | diffusion agent composition (at. ratio) | mass ratio (diffusion auxiliary agent:diffusion agent) | RH oxide sheet | RH amount per 1 $mm^2$ of diffusion surface (mg) | |
|---|---|---|---|---|---|---|---|
| 1 | $Nd_{70}Cu_{30}$ | 520 | $Tb_4O_7$ | 4:6 | $Tb_4O_7$ 25 μm | 0.08 | Comparative Example |
| 2 | $Nd_{70}Cu_{30}$ | 520 | $Tb_4O_7$ | 5:5 | $Tb_4O_7$ 25 μm | 0.08 | Example |
| 3 | $Nd_{70}Cu_{30}$ | 520 | $Tb_4O_7$ | 6:4 | $Tb_4O_7$ 25 μm | 0.08 | Example |
| 4 | $Nd_{70}Cu_{30}$ | 520 | $Tb_4O_7$ | 7:3 | $Tb_4O_7$ 25 μm | 0.08 | Example |
| 5 | $Nd_{70}Cu_{30}$ | 520 | $Tb_4O_7$ | 8:2 | $Tb_4O_7$ 25 μm | 0.08 | Example |
| 6 | $Nd_{70}Cu_{30}$ | 520 | $Tb_4O_7$ | 9:1 | $Tb_4O_7$ 25 μm | 0.08 | Example |
| 7 | $Nd_{70}Cu_{30}$ | 520 | $Tb_4O_7$ | 9.6:0.4 | $Tb_4O_7$ 25 μm | 0.08 | Example |
| 8 | $Nd_{70}Cu_{30}$ | 520 | $Dy_2O_3$ | 8:2 | $Dy_2O_3$ 25 μm | 0.08 | Example |
| 9 | $Nd_{70}Cu_{30}$ | 520 | NONE | — | — | 0.00 | Comparative Example |
| 10 | NONE | — | $Tb_4O_7$ | — | $Tb_4O_7$ 50 μm | 0.16 | Comparative Example |
| 11 | NONE | — | $Dy_2O_3$ | — | $Dy_2O_3$ 50 μm | 0.16 | Comparative Example |

These sintered R-T-B based magnet matrices were placed on an Mo plate and accommodated in a process chamber (vessel), which was then lidded. (This lid does not hinder gases from going into and coming out of the chamber). This was accommodated in a heat treatment furnace, and in an Ar ambient of 100 Pa, a heat treatment was performed at 900° C. for 4 hours. As for the heat treatment, by warming up from room temperature with evacuation so that the ambient pressure and temperature met the aforementioned conditions, the heat treatment was performed under the aforementioned conditions. Thereafter, once cooled down to room temperature, the Mo plate was taken out and the sintered R-T-B based magnet was collected. The collected sintered R-T-B based magnet was returned in the process chamber, and again accommodated in the heat treatment furnace, and 2 hours of heat treatment was performed at 500° C. in a vacuum of 10 Pa or less. Regarding this heat treatment, too, by warming up from room temperature with evacuation so that the ambient pressure and temperature met the aforementioned conditions, the heat treatment was performed under the aforementioned conditions. Thereafter, once cooled down to room temperature, the sintered R-T-B based magnet was collected.

The surface of the resultant sintered R-T-B based magnet was removed via machining by 0.2 mm each, thus providing Samples 1 to 11 which were 6.5 mm×7.0 mm×7.0 mm. Magnetic characteristics of Samples 1 to 11 thus obtained were measured with a B-H tracer, and variations in $H_{cJ}$ and $B_r$ ($\Delta H_{cJ}$ and $\Delta B_r$) with respect to the sintered R-T-B based magnet matrix were determined. The results are shown in Table 2.

TABLE 2

| Sample No. | $H_{cJ}$ (kA/m) | $B_r$(T) | $\Delta H_{cJ}$ (kA/m) | $\Delta$Br(T) | |
|---|---|---|---|---|---|
| 1 | 1230 | 1.45 | 195 | 0.00 | Comparative Example |
| 2 | 1354 | 1.44 | 319 | −0.01 | Example |
| 3 | 1375 | 1.45 | 340 | 0.00 | Example |
| 4 | 1393 | 1.44 | 358 | −0.01 | Example |

TABLE 2-continued

| Sample No. | $H_{cJ}$ (kA/m) | $B_r$(T) | $\Delta H_{cJ}$ (kA/m) | $\Delta$Br(T) | |
|---|---|---|---|---|---|
| 5 | 1400 | 1.44 | 365 | −0.01 | Example |
| 6 | 1408 | 1.44 | 373 | −0.01 | Example |
| 7 | 1395 | 1.44 | 360 | −0.01 | Example |
| 8 | 1306 | 1.44 | 271 | −0.01 | Example |
| 9 | 1062 | 1.45 | 27 | 0.00 | Comparative Example |
| 10 | 1065 | 1.45 | 30 | 0.00 | Comparative Example |
| 11 | 1059 | 1.45 | 24 | 0.00 | Comparative Example |

As can be seen from Table 2, $H_{cJ}$ is significantly improved without lowering $B_r$ in the sintered R-T-B based magnets according to the production method of the present invention; on the other hand, in Sample 1 having more diffusion agent than defined by the mixed mass ratio according to the present invention, the $H_{cJ}$ improvement was not comparable to that attained by the present invention. Moreover, in Sample 9 which had only the diffusion auxiliary agent layer, and in Samples 10 and 11 which had only the diffusion agent, the $H_{cJ}$ improvement was also not comparable to that attained by the present invention.

Experimental Example 2

Samples 12 to 19 and Samples 33 and 34 were obtained in a similar manner to Experimental Example 1, except for using diffusion auxiliary agents having compositions as shown in Table 3, applied so that the mass ratio between the diffusion auxiliary agent and the diffusion agent had values as shown in Table 3. Magnetic characteristics of Samples 12 to 19 and Samples 33 and 34 thus obtained were measured with a B-H tracer in a similar manner to Experimental Example 1, and variations in $H_{cJ}$ and $B_r$ were determined. The results are shown in Table 4.

TABLE 3

| Sample No. | diffusion auxiliary agent composition (at. ratio) | diffusion auxiliary agent melting point (° C.) | diffusion agent composition (at. ratio) | mass ratio (diffusion auxiliary agent:diffusion agent) | RH oxide sheet | RH amount per 1 mm² of diffusion surface (mg) | |
|---|---|---|---|---|---|---|---|
| 12 | $Nd_{95}Cu_5$ | 930 | $Tb_4O_7$ | 8:2 | $Tb_4O_7$ 25 μm | 0.08 | Comparative Example |
| 13 | $Nd_{85}Cu_{15}$ | 770 | $Tb_4O_7$ | 8:2 | $Tb_4O_7$ 25 μm | 0.08 | Example |
| 14 | $Nd_{50}Cu_{50}$ | 690 | $Tb_4O_7$ | 8:2 | $Tb_4O_7$ 25 μm | 0.08 | Example |
| 15 | $Nd_{27}Cu_{73}$ | 770 | $Tb_4O_7$ | 8:2 | $Tb_4O_7$ 25 μm | 0.08 | Comparative Example |
| 16 | $Nd_{80}Fe_{20}$ | 690 | $Tb_4O_7$ | 8:2 | $Tb_4O_7$ 25 μm | 0.08 | Example |
| 17 | $Nd_{80}Ga_{20}$ | 650 | $Tb_4O_7$ | 8:2 | $Tb_4O_7$ 25 μm | 0.08 | Example |
| 18 | $Nd_{80}Co_{20}$ | 630 | $Tb_4O_7$ | 8:2 | $Tb_4O_7$ 25 μm | 0.08 | Example |
| 19 | $Nd_{80}Ni_{20}$ | 580 | $Tb_4O_7$ | 8:2 | $Tb_4O_7$ 25 μm | 0.08 | Example |
| 33 | $Pr_{68}Cu_{32}$ | 470 | $Tb_4O_7$ | 8:2 | $Tb_4O_7$ 25 μm | 0.08 | Example |
| 34 | $Nd_{55}Pr_{15}Cu_{30}$ | 510 | $Tb_4O_7$ | 8:2 | $Tb_4O_7$ 25 μm | 0.08 | Example |

TABLE 4

| Sample No. | $H_{cJ}$ (kA/m) | $B_r$(T) | $\Delta$HcJ (kA/m) | $\Delta$Br(T) | |
|---|---|---|---|---|---|
| 12 | 1180 | 1.45 | 145 | 0.00 | Comparative Example |
| 13 | 1321 | 1.45 | 286 | 0.00 | Example |
| 14 | 1333 | 1.44 | 298 | −0.01 | Example |
| 15 | 1101 | 1.45 | 66 | 0.00 | Comparative Example |
| 16 | 1363 | 1.44 | 328 | −0.01 | Example |
| 17 | 1378 | 1.44 | 343 | −0.01 | Example |
| 18 | 1381 | 1.45 | 346 | 0.00 | Example |
| 19 | 1369 | 1.44 | 334 | −0.01 | Example |
| 33 | 1417 | 1.44 | 382 | −0.01 | Example |
| 34 | 1405 | 1.44 | 370 | −0.01 | Example |

As can be seen from Table 4, also in the case of using diffusion auxiliary agents of different compositions from those of the diffusion auxiliary agents used in Experimental Example 1, $H_{cJ}$ is significantly improved while hardly lowering $B_r$ in the sintered R-T-B based magnets according to the production method of the present invention (Samples 13, 14, 16 to 19, 33 and 34). However, in Sample 12 where the melting point of the RLM alloy exceeded the heat treatment temperature (900° C.), and in Sample 15 where a diffusion auxiliary agent with less than 50 at % of an RL was used, the $H_{cJ}$ improvement was not comparable to that attained by the present invention.

Experimental Example 3

Samples 20 to 25 were obtained in a similar manner to Experimental Example 1, except for using diffusion auxiliary agents having compositions as shown in Table 5, applied so that the mass ratio between the diffusion auxiliary agent had values as shown in Table 5, and placing as many RH oxide sheets as indicated in Table 5, these RH oxide sheets being as described in Table 5. Sample 23 had its RH amount per 1 $mm^2$ of the surface of the sintered R-T-B based magnet (diffusion surface) increased to a value as indicated in Table 5, while having the same diffusion auxiliary agent and diffusion agent and the same mass ratio as those in Sample 1, which did not attain a favorable result in Experimental Example 1 (where more diffusion agent than defined by the mass ratio according to the present invention was contained). Sample 24 had its RH amount per 1 $mm^2$ of the surface of the sintered R-T-B based magnet (diffusion surface) increased to a value as indicated in Table 5, while having the same diffusion auxiliary agent and diffusion agent and the same mass ratio as those in Sample 15, which did not attain a favorable result in Experimental Example 2 (where a diffusion auxiliary agent with less than 50 at % of an RL was used). In Sample 25, an RHM alloy was used as the diffusion auxiliary agent. Magnetic characteristics of Samples 20 to 25 thus obtained were measured with a B-H tracer in a similar manner to Experimental Example 1, and variations in $H_{cJ}$ and $B_r$ were determined. The results are shown in Table 6. Note that each table indicates values of Sample 5 as an Example for comparison.

TABLE 5

| Sample No. | diffusion auxiliary agent composition (at. ratio) | diffusion auxiliary agent melting point (° C.) | diffusion agent composition (at. ratio) | mass ratio (diffusion auxiliary agent:diffusion agent) | RH amount per 1 $mm^2$ of diffusion surface (mg) | RH oxide sheet | |
|---|---|---|---|---|---|---|---|
| 5 | $Nd_{70}Cu_{30}$ | 520 | $Tb_4O_7$ | 8:2 | 0.08 | $Tb_4O_7$ 25 μm | Example |
| 20 | $Nd_{70}Cu_{30}$ | 520 | $Tb_4O_7$ | 8:2 | 0.05 | $Tb_4O_7$ 15 μm | Example |
| 21 | $Nd_{70}Cu_{30}$ | 520 | $Tb_4O_7$ | 8:2 | 0.16 | $Tb_4O_7$ 50 μm | Example |
| 22 | $Nd_{70}Cu_{30}$ | 520 | $Tb_4O_7$ | 8:2 | 0.32 | 2 sheets of $Tb_4O_7$ 50 μm | Example |
| 23 | $Nd_{70}Cu_{30}$ | 520 | $Tb_4O_7$ | 4:6 | 0.48 | 3 sheets of $Tb_4O_7$ 50 μm | Comparative Example |
| 24 | $Nd_{27}Cu_{73}$ | 770 | $Tb_4O_7$ | 8:2 | 0.48 | 3 sheets of $Tb_4O_7$ 50 μm | Comparative Example |
| 25 | $Tb_{74}Cu_{26}$ | 860 | $Tb_4O_7$ | 8:2 | 2.47 | 3 sheets of $Tb_4O_7$ 50 μm | Comparative Example |

TABLE 6

| Sample No. | $H_{cJ}$ (kA/m) | $B_r$(T) | ⊿$H_{cJ}$ (kA/m) | ⊿Br(T) | |
|---|---|---|---|---|---|
| 5 | 1400 | 1.44 | 365 | −0.01 | Example |
| 20 | 1379 | 1.45 | 344 | 0.00 | Example |

TABLE 6-continued

| Sample No. | $H_{cJ}$ (kA/m) | $B_r$(T) | ⊿$H_{cJ}$ (kA/m) | ⊿Br(T) | |
|---|---|---|---|---|---|
| 21 | 1434 | 1.44 | 399 | −0.01 | Example |
| 22 | 1448 | 1.44 | 413 | −0.01 | Example |
| 23 | 1454 | 1.44 | 419 | −0.01 | Comparative Example |
| 24 | 1130 | 1.45 | 95 | 0.00 | Comparative Example |
| 25 | 1485 | 1.43 | 450 | −0.02 | Comparative Example |

As can be seen from Table 6, also in the case of applying a diffusion auxiliary agent and placing an RH oxide sheet(s) so that the RH amount per 1 $mm^2$ of the surface of the sintered R-T-B based magnet (diffusion surface) has a value as shown in Table 5, $H_{cJ}$ is significantly improved without lowering $B_r$ in the sintered R-T-B based magnets according to the production method of the present invention.

In Sample 23 containing more diffusion agent than defined by the mass ratio according to the present invention, a similar $H_{cJ}$ improvement to that attained by the sintered R-T-B based magnets according to the production method of the present invention was made. However, their RH amount per 1 $mm^2$ of the surface of the sintered R-T-B based magnet (diffusion surface) was greater than that in the sintered R-T-B based magnet according to the present invention; thus, more RH than in the present invention was required in order to attain a similar level of $H_{cJ}$ improvement, falling short of an effect of improving $H_{cJ}$ with only a small amount of RH. In Sample 24 where a diffusion auxiliary agent with less than 50 at % of an RL was used, the proportion of RL in the diffusion auxiliary agent was small, and thus a similar $H_{cJ}$ improvement to that attained by the sintered R-T-B based magnets according to the production method of the present invention was not attained even by increasing the RH amount per 1 $mm^2$ of the surface of the sintered R-T-B based magnet (diffusion surface). In Sample 25 where an RHM alloy was used as the diffusion auxiliary agent, a similar $H_{cJ}$ improvement to that attained by the sintered R-T-B based magnets according to the production method of the present invention was made. However, their RH amount per 1 $mm^2$ of the surface of the sintered R-T-B based magnet (diffusion surface) was much greater than that in the sintered R-T-B based magnet according to the present invention; thus, more RH than in the present invention was required in order to attain a similar level of $H_{cJ}$ improvement, falling short of an effect of improving $H_{cJ}$ with only a small amount of RH.

Experimental Example 4

Samples 26 to 28 were obtained in a similar manner to Experimental Example 1, except for applying a diffusion auxiliary agent of the composition $Nd_{70}Cu_{30}$ (at %) so that the mass ratio between the diffusion auxiliary agent and the diffusion agent was 9:1, placing one $Tb_4O_7$ sheet having a thickness of 25 μm, and performing a heat treatment under conditions as shown in Table 7. Magnetic characteristics of Samples 26 to 28 thus obtained were measured with a B-H tracer in a similar manner to Experimental Example 1, and variations in $H_{cJ}$ and $B_r$ were determined. The results are shown in Table 8.

TABLE 7

| Sample No. | heat treatment temperature (° C.) | heat treatment time (Hr) | |
|---|---|---|---|
| 26 | 900 | 8 | Example |
| 27 | 950 | 4 | Example |
| 28 | 850 | 16 | Example |

TABLE 8

| Sample No. | $H_{cJ}$ (kA/m) | $B_r$(T) | ⊿$H_{cJ}$ (kA/m) | ⊿Br(T) | |
|---|---|---|---|---|---|
| 26 | 1472 | 1.44 | 437 | −0.01 | Example |
| 27 | 1446 | 1.44 | 411 | −0.01 | Example |
| 28 | 1425 | 1.45 | 390 | 0.00 | Example |

As can be seen from Table 8, also in the case of performing a heat treatment under various heat treatment condition as shown in Table 7, $H_{cJ}$ is significantly improved without lowering $B_r$ in the sintered R-T-B based magnets according to the production method of the present invention.

Experimental Example 5

Samples 29 to 32 were obtained in a similar manner to Sample 5, except for using sintered R-T-B based magnet matrices of compositions, sintering temperatures, amounts of impurities, and magnetic characteristics as shown in Table 9. Magnetic characteristics of Samples 29 to 32 thus obtained were measured with a B-H tracer in a similar manner to Experimental Example 1, and variations in $H_{cJ}$ and $B_r$ were determined. The results are shown in Table 10.

TABLE 9

| Sample No. | matrix composition (at. %) | sintering temperature (° C.) | amount of impurities (mass ppm) oxygen | nitrogen | carbon | matrix $H_{cJ}$ (kA/m) | matrix $B_r$ (T) |
|---|---|---|---|---|---|---|---|
| 29 | $Nd_{13.4}B_{5.8}Al_{0.5}Cu_{0.1}Fe_{bal.}$ | 1050 | 810 | 520 | 980 | 1027 | 1.44 |
| 30 | $Nd_{12.6}Dy_{0.8}B_{5.8}Al_{0.5}Cu_{0.1}Co_{1.1}Fe_{bal.}$ | 1060 | 780 | 520 | 930 | 1205 | 1.39 |
| 31 | $Nd_{13.7}B_{5.8}Al_{0.5}Cu_{0.1}Co_{1.1}Fe_{bal.}$ | 1040 | 1480 | 450 | 920 | 1058 | 1.44 |
| 32 | $Nd_{14.5}B_{5.9}Al_{0.5}Cu_{0.1}Co_{1.1}Fe_{bal.}$ | 1035 | 4030 | 320 | 930 | 1073 | 1.41 |

TABLE 10

| Sample No. | $H_{cJ}$ (kA/m) | $B_r$(T) | ⊿$H_{cJ}$ (kA/m) | ⊿Br(T) | |
|---|---|---|---|---|---|
| 29 | 1401 | 1.43 | 374 | −0.01 | Example |
| 30 | 1565 | 1.38 | 360 | −0.01 | Example |
| 31 | 1449 | 1.43 | 391 | −0.01 | Example |
| 32 | 1446 | 1.41 | 373 | 0.00 | Example |

As can be seen from Table 10, also in the case of using various sintered R-T-B based magnet matrices as shown in Table 9, $H_{cJ}$ is significantly improved without lowering $B_r$ in the sintered R-T-B based magnets according to the production method of the present invention, Experimental Example 6

Sheets containing the same RH oxides that were used in Experimental Example 1 were provided. Specifically, each sheet contained $Tb_4O_7$ or $Dy_2O_3$ such that there was 0.08 mg of RH per 1 $mm^2$.

Sheet compacts containing an RLM alloy powder were produced as follows.

First, RLM alloy powders (diffusion auxiliary agents) having compositions as shown in Table 11 were provided. The RLM alloy powders were spherical powders with a particle size of 100 μm or less which had been produced by a centrifugal atomization technique (i.e., from which particles of particle sizes above 100 μm had been removed by sieving).

Similarly to producing the sheet compacts containing an RH oxide, sheets of RLM alloy powder were produced so that the mass ratio between the RLM alloy powder and the RH oxide had values as shown in Table 11.

On each of two 7.4 mm×7.4 mm faces of a sintered R-T-B based magnet matrix, the RH oxide sheet and the RLM alloy powder sheet thus provided, having been cut into 7.4 mm×7.4 mm, were placed in the order of, from the magnet, the RLM alloy sheet and then the RH oxide sheet. After a small amount of ethanol was sprayed from above, this was subjected to hot air drying with a drier, whereby each sheet was placed in close contact with the magnet surface. Such sintered R-T-B based magnet matrices were subjected to heat treatment and processing similarly to Experimental Example 1, whereby Samples 35 to 37 were obtained.

Magnetic characteristics of Samples thus obtained were measured with a B-H tracer, and variations in $H_{cJ}$ and $B_r$ were determined. The results are shown in Table 12. It can be seen from Table 12 that $H_{cJ}$ is also improved in the Samples where sheets of diffusion auxiliary agent and sheets of diffusion agent are used.

TABLE 11

| Sample No. | diffusion auxiliary agent composition (at. ratio) | diffusion auxiliary agent melting point (° C.) | diffusion agent composition (at. ratio) | mass ratio (diffusion auxiliary agent:diffusion agent) | RH compound sheet | RH amount per 1 mm² of diffusion surface (mg) | |
|---|---|---|---|---|---|---|---|
| 35 | $Nd_{70}Cu_{30}$ | 520 | $Tb_4O_7$ | 8:2 | $Tb_4O_7$ 25 μm | 0.08 | Example |
| 36 | $Nd_{70}Cu_{30}$ | 520 | $Dy_2O_3$ | 8:2 | $Tb_4O_7$ 25 μm | 0.08 | Example |
| 37 | $Nd_{80}Fe_{20}$ | 690 | $Tb_4O_7$ | 8:2 | $Tb_4O_7$ 25 μm | 0.08 | Example |

TABLE 12

| Sample No. | $H_{cJ}$ (kA/m) | $B_r$(T) | $\Delta H_{cJ}$ (kA/m) | $\Delta$Br(T) | |
|---|---|---|---|---|---|
| 35 | 1395 | 1.45 | 360 | 0.00 | Example |
| 36 | 1293 | 1.44 | 258 | −0.01 | Example |
| 37 | 1390 | 1.44 | 355 | −0.01 | Example |

TABLE 14

| Sample No. | $H_{cJ}$ (kA/m) | $B_r$(T) | $\Delta H_{cJ}$ (kA/m) | $\Delta$Br(T) | |
|---|---|---|---|---|---|
| 38 | 1390 | 1.44 | 355 | −0.01 | Example |
| 39 | 1297 | 1.44 | 262 | −0.01 | Example |
| 40 | 1380 | 1.45 | 345 | 0.00 | Example |

Experimental Example 7

RLM alloy powders (diffusion auxiliary agents) having compositions as shown in Table 13 were provided. The RLM alloy powders were spherical powders with a particle size of 100 μm or less which had been produced by a centrifugal atomization technique (i.e., from which particles of particle sizes above 100 μm had been removed by sieving).

The resultant RLM alloy powder was mixed with $Tb_4O_7$ powder or $Dy_2O_3$ powder having a particle size 20 μm or less at a mixing ratio as shown in Table 13, thereby obtaining a powder mixture. By using this powder mixture, similarly to producing sheet compacts containing an RH oxide, sheets of powder mixture were produced.

On two 7.4 mm×7.4 mm faces of a sintered R-T-B based magnet matrix, the powder mixture sheets having been cut into 7.4 mm×7.4 mm were placed. After a small amount of ethanol was sprayed from above the sheets, this was subjected to hot air drying with a drier, whereby each sheet was placed in close contact with the magnet surface.

Such sintered R-T-B based magnet matrices were subjected to heat treatment and processing similarly to Experimental Example 1, whereby Samples 38 to 40 were obtained. Magnetic characteristics of Samples thus obtained were measured with a B-H tracer, and variations in $H_{cJ}$ and $B_r$ were determined. The results are shown in Table 14.

It can be seen from Table 14 that $H_{cJ}$ is also improved in Samples in which sheets of powder mixture are used.

TABLE 13

| Sample No. | diffusion auxiliary agent composition (at. ratio) | diffusion auxiliary agent melting point (° C.) | diffusion agent composition (at. ratio) | mixing ratio (diffusion auxiliary agent:diffusion agent) | RH amount per 1 mm² of diffusion surface (mg) | |
|---|---|---|---|---|---|---|
| 38 | $Nd_{70}Cu_{30}$ | 520 | $Tb_4O_7$ | 6:4 | 0.08 | Example |
| 39 | $Nd_{70}Cu_{30}$ | 520 | $Dy_2O_3$ | 6:4 | 0.08 | Example |
| 40 | $Nd_{80}Fe_{20}$ | 690 | $Tb_4O_7$ | 6:4 | 0.08 | Example |

Experimental Example 8

Sheets containing the same RH oxides that were used in Experimental Example 1 were provided. Specifically, each sheet contained $Tb_4O_7$ or $Dy_2O_3$ such that there was 0.08 mg of RH per 1 mm². These sheets were each cut into two pieces: 7.4 mm×30 mm and 7.4 mm×6.9 mm.

RLM alloy powders having compositions as shown in Table 15 were provided, and a slurry of RLM alloy powder was obtained by the same method as in Experimental Example 1. This slurry was applied onto the entire surface of the sintered R-T-B based magnet matrix, so that the mass ratio between the RLM alloy in the slurry and the RH oxide in the RH oxide sheet would attain values as shown in Table 15.

After the slurry was applied, four faces of the dried magnet surface, being 7.4 mm×7.4 mm and 7.4 mm×6.9 mm, were snugly enwrapped with an RH oxide sheet having been cut into 7.4 mm×30 mm, and any excess sheet was cut off. After a small amount of ethanol was sprayed from above the enwrapping sheet, this was subjected to hot air drying with a drier, whereby the sheet was placed in close contact with the magnet surface. Also on the two remaining faces unwrapped by the sheet, 7.4 mm×6.9 mm sheets were placed, and after a small amount of ethanol was sprayed from above the sheets, this was subjected to hot air drying with a drier, whereby each sheet was placed in close contact with the magnet surface.

Such sintered R-T-B based magnet matrices were subjected to heat treatment and processing similarly to Experimental Example 1, whereby Samples 41 to 43 were obtained. Magnetic characteristics of Samples thus obtained were measured with a B-H tracer, and variations in $H_{cJ}$ and $B_r$ were determined. The results are shown in Table 16.

It can be seen from Table 16 that $H_{cJ}$ is also improved in the Samples where enwrapping sheets are used and subjected to a heat treatment.

TABLE 15

| Sample No. | diffusion auxiliary agent composition (at. ratio) | diffusion auxiliary agent melting point (° C.) | diffusion agent composition (at. ratio) | mass ratio (diffusion auxiliary agent:diffusion agent) | RH compound sheet | RH amount per 1 mm² of diffusion surface (mg) | |
|---|---|---|---|---|---|---|---|
| 41 | $Nd_{70}Cu_{30}$ | 520 | $Tb_4O_7$ | 7:3 | $Tb_4O_7$ 25 μm | 0.08 | Example |
| 42 | $Nd_{70}Cu_{30}$ | 520 | $Dy_2O_3$ | 7:3 | $Tb_4O_7$ 25 μm | 0.08 | Example |
| 43 | $Nd_{80}Fe_{20}$ | 690 | $Tb_4O_7$ | 7:3 | $Tb_4O_7$ 25 μm | 0.08 | Example |

TABLE 16

| Sample No. | $H_{cJ}$ (kA/m) | $B_r$(T) | $\Delta H_{cJ}$ (kA/m) | $\Delta$Br(T) | |
|---|---|---|---|---|---|
| 41 | 1606 | 1.43 | 571 | −0.02 | Example |
| 42 | 1464 | 1.43 | 429 | −0.02 | Example |
| 43 | 1609 | 1.44 | 574 | −0.01 | Example |

INDUSTRIAL APPLICABILITY

A method for producing a sintered R-T-B based magnet according to the present invention can provide a sintered R-T-B based magnet whose $H_{cJ}$ is improved with less of a heavy rare-earth element RH.

REFERENCE SIGNS LIST

10 sintered R-T-B based magnet
20, 20*a*, 20*b* sheet compact
30 layer of RLM alloy powder particles

The invention claimed is:

1. A method for producing a sintered R-T-B based magnet, comprising:

a step of providing a sintered R-T-B based magnet, where R is one or more rare-earth elements, T is one or more transition metal elements, and B is boron or is boron and carbon;

a step of coating a surface of the sintered R-T-B based magnet with a layer of RLM alloy powder (where RL is Nd and/or Pr; M is one or more elements selected from the group consisting of Cu, Fe, Ga, Co, Ni and Al), and placing thereon a sheet compact containing an RH oxide powder (where RH is Dy and/or Tb) and a resin component; and a step of performing a heat treatment at a sintering temperature of the sintered R-T-B based magnet or lower, wherein the RLM alloy powder contains RL in an amount of 50 at % or more, and a melting point of the RLM alloy powder is equal to or less than a temperature of the heat treatment; and the heat treatment is performed while the RLM alloy powder and the RH oxide powder are present on the surface of the sintered R-T-B based magnet at a mass ratio of RLM alloy powder: RH oxide powder=9.6:0.4 to 5:5.

2. The method for producing a sintered R-T-B based magnet of claim 1, wherein, in the sheet compact containing the RH oxide powder and the resin component to be present on the surface of the sintered R-T-B based magnet, the RH has a mass of 0.03 to 0.35 mg per 1 mm² of the surface.

3. The method for producing a sintered R-T-B based magnet of claim 1, wherein the sheet compact containing the RH oxide powder and the resin component also includes the RLM alloy powder.

4. A method for producing a sintered R-T-B based magnet, comprising:

a step of providing a sintered R-T-B based magnet, where R is one or more rare-earth elements, T is one or more transition metal elements, and B is boron or is boron and carbon;

a step of placing a first sheet compact containing an RLM alloy powder (where RL is Nd and/or Pr; M is one or more elements selected from the group consisting of Cu, Fe, Ga, Co, Ni and Al) and a resin component on a surface of the sintered R-T-B based magnet, and placing thereon a second sheet compact containing an RH oxide powder (where RH is Dy and/or Tb) and the resin component; and a step of performing a heat treatment at a sintering temperature of the sintered R-T-B based magnet or lower, wherein the RLM alloy powder contains RL in an amount of 50 at % or more, and a melting point of the RLM alloy powder is equal to or less than a temperature of the heat treatment; and the heat treatment is performed while the RLM alloy powder and the RH oxide powder are present on the surface of the sintered R-T-B based magnet at a mass ratio of RLM alloy powder:RH oxide powder=9.6:0.4 to 5:5.

* * * * *